US005459430A

United States Patent [19]

Ryat

[11] Patent Number: 5,459,430

[45] Date of Patent: Oct. 17, 1995

[54] RESISTOR RATIOED CURRENT MULTIPLIER/DIVIDER

[75] Inventor: Marc H. Ryat, Fort Collins, Colo.

[73] Assignee: SGS-Thomson Microelectronics, Inc., Carrollton, Tex.

[21] Appl. No.: 189,102

[22] Filed: Jan. 31, 1994

[51] Int. Cl.[6] ..... G05F 3/02

[52] U.S. Cl. ..... 327/538; 327/540; 327/542; 327/543; 327/546

[58] Field of Search ..... 307/296.1, 296.4, 307/296.5, 296.6, 296.7, 296.8; 327/530, 538, 540, 543, 545, 546, 541, 542

[56] References Cited

U.S. PATENT DOCUMENTS

| | | | |
|---|---|---|---|
| 3,651,346 | 3/1972 | Limberg | 307/296.1 |
| 4,055,774 | 10/1977 | Ahmed | 307/296.1 |
| 4,443,753 | 4/1984 | McGlinchey | 307/296.8 |
| 4,593,208 | 6/1986 | Single | 307/296.7 |
| 4,675,594 | 6/1987 | Reinke | 307/296.7 |
| 5,008,609 | 4/1991 | Fukiage | 307/296.8 |
| 5,350,998 | 9/1994 | Marchió et al. | 307/296.1 |

*Primary Examiner*—Terry D. Cunningham

*Attorney, Agent, or Firm*—Richard A. Bachand; Rodney M. Anderson; Lisa K. Jorgenson

[57] ABSTRACT

A wideband current multiplying divider circuit that produces an output current of any ratio to the input current has a first bipolar transistor and a first reference current source connected in series between a supply voltage and ground. A second bipolar transistor and a second reference current source are also connected in series between the supply voltage and around. A summation current source is connected at one side to ground and at the other side to a divided current path. A first resistor is connected in series with the station current source between a base of the first bipolar transistor and ground, and through which an input current can be connected to flow. A second resistor is connected in series with the summation current source between a base of the second bipolar transistor and ground, and through which an output current can be connected to flow. The ratio of the input to output currents is determined by the ratio of the first and second resistors, wherein the output current can be a multiplied or divided value of the input current. The first and second bipolar transistors are NPN transistors, and the first and second reference current sources source substantially equal reference currents. The circuit may further include a cascode circuit connected to substantially remove any Early effect error between the first and second bipolar transistors.

12 Claims, 2 Drawing Sheets

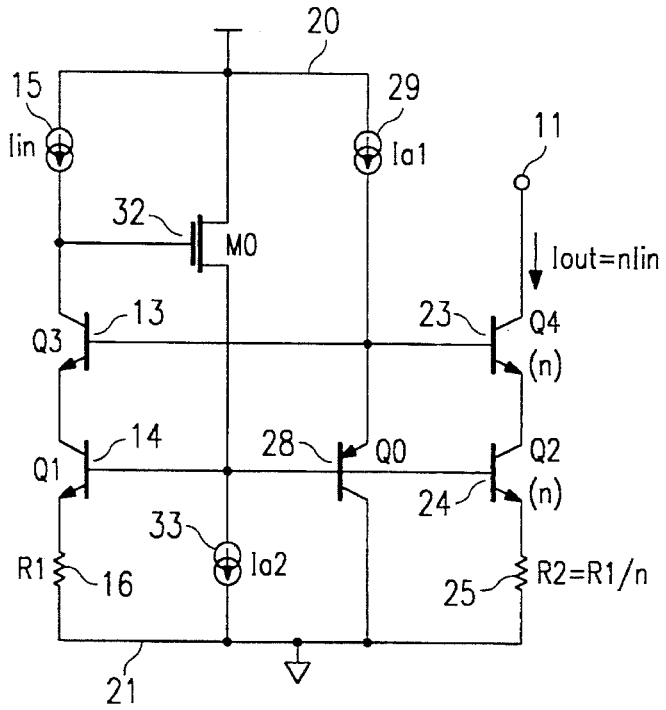
FIG. 1
(PRIOR ART)
FIG. 2
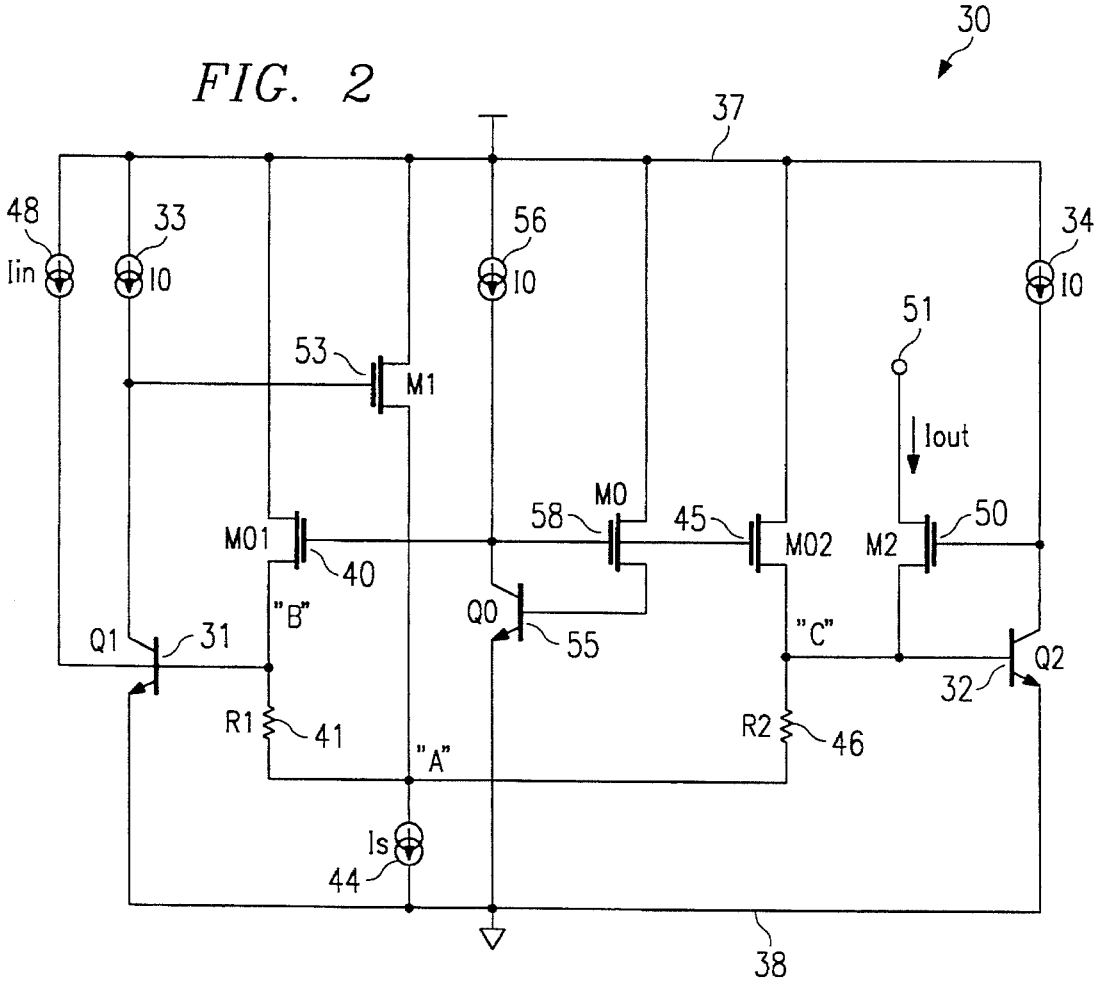

RESISTOR RATIOED CURRENT MULTIPLIER/DIVIDER

BACKGROUND OF THE INVENTION

1. Field of the Invention

This invention relates to improvements in current multiplying and dividing circuits, and more particularly to improvements in current multiplying and dividing circuits that enable current multiplication by values that are not restricted to integer values.

2. Relevant Background

Presently, circuits for performing current multiplication or division are restricted to performing integer multiplications or divisions. An example of such circuit is shown in FIG. 1, in which a circuit 10 uses a current mirror arrangement to produce an output current Iout on node 11 that is n times the input current Iin. The current mirror circuit has an input current path through two NPN transistors 13 and 14 connected in series with the input current source 15 and a resistor 16 between a $V_{cc}$ rail 20 and ground. An output current path is provided by NPN transistors 23 and 24 in series with a resistor 25, connected between the output terminal 11 and ground 21. The emitters of the NPN transistors 23 and 24 in the output current flow path are n-times the size of the emitters of the respective NPN transistors 13 and 14 in the input current flow path, and, the resistor 16 is n-times the size of the resistor 25 in the output current flow path. Accordingly, the current that flows in the current path through the NPN transistors 23 and 24 and the resistor 25 mirrors the current that flows in the NPN transistors 13 and 14 and the resistor 16, multiplied by the value of n.

The circuit 10 also has a PNP transistor 28 connected in a current flow path with a first current source 29 between the $V_{cc}$ rail 20 and ground 21. Also, a N-channel MOS transistor 32 is connected in a current flow path with a second current source 33 between the $V_{cc}$ rail 20 and ground 21. The bases of the NPN transistors 14 and 24 and the base of the PNP transistor 28 are connected together and to the source of the NMOS transistor 32 and the second current source 33. Similarly, the bases of the NPN transistors 13 and 23 are connected together and to the emitter of the the PNP transistor 28.

SUMMARY OF THE INVENTION

In light of the above it is an object of the invention to provide an improved resistor ratioed current multiplier/divider circuit.

It is another object of the invention to provide an improved resistor ratioed current multiplier/divider circuit of the type described that can multiply a current by a value that need not be an integer.

It is another object of the invention to provide an improved resistor ratioed current multiplier/divider circuit of the type described that has a compact arrangement of resistors and equal-sized transistors, and has an accuracy determined essentially by resistor matching.

It is still another object of the invention to provide an improved resistor ratioed current multiplier/divider circuit of the type described that has a quasi-open-loop design and provides a high speed capability.

It is yet another object of the invention to provide an improved resistor ratioed current multiplier/divider circuit of the type described that requires no operational amplifiers.

It is still yet another object of the invention to provide an improved resistor ratioed current multiplier/divider circuit of the type described that has a high-impedance cascoded output.

These and other objects, features and advantages will become apparent to those skilled in the art from the following detailed description, when read in conjunction with the accompanying drawings and appended claims.

In accordance with a broad aspect of the invention, a current multiplier/divider circuit is presented that has first, second, and third current paths between a supply voltage and a reference potential. Each of the current paths has a reference current source and a bipolar transistor in series. A fourth current path has a summation current source connected at a first side to the reference potential, and has first and second divided current paths. Each of the divided current paths has an MOS transistor and a resistor in series between the supply voltage and another side of the summation current source, a base of the bipolar transistors of the first and third current paths being connected between the MOS transistor and the resistor respectively in the first and second divided current paths. A fifth current path has an MOS transistor between the supply voltage and a base of the bipolar transistor of the second current path. A sixth current path has an MOS transistor between the supply voltage and the other side of the summation current source, and has a gate connected between the reference current source and the bipolar transistor of the fifth current path. An output current path, has an MOS transistor between a current output terminal and the base of the bipolar transistor of the third current path, and has a gate connected between the reference current source and bipolar transistor of the third current path. When an input current is applied between the supply voltage and the base of the bipolar transistor of the first current path, an output current is developed at the current output terminal that has a magnitude proportional to the input current according to the ratio of the resistors of the first and second divided current paths.

In the current multiplier/divider, the reference current sources preferably supply substantially equal currents, the bipolar transistors are NPN transistors, and the MOS transistors are NMOS transistors. First and second cascode bipolar transistors may also be connected in series with the bipolar transistors of the first, second and third current paths, each having a base connected to a reference potential, whereby any Early effects between the bipolar transistors of the first and third current paths are reduced.

In accordance with another broad aspect of the invention, a current multiplier/divider circuit is presented that has a first bipolar transistor and a first reference current source connected in series between a supply voltage and ground. A second bipolar transistor and a second reference current source are also connected in series between the supply voltage and ground. A summation current source is connected at one side to ground and at the other side to a divided current path. A first resistor is connected in series with the summation current source between a base of the first bipolar transistor and ground, and through which an input current can be connected to flow. A second resistor is connected in series with the summation current source between a base of the second bipolar transistor and ground, and through which an output current can be connected to flow. The ratio of the input to output currents is determined by the ratio of the first and second resistors, wherein the output current can be a multiplied or divided value of the input current.

In a preferred embodiment, the first and second bipolar transistors are NPN transistors, and the first and second reference current sources provide substantially equal reference currents.

The circuit may also include for base currents compensation a circuit having a third bipolar transistor and a third current source connected in series between the supply voltage and ground, and first, second, and third MOS transistors connected between the supply voltage respectively to bases of the first, second and third bipolar transistors, each MOS transistor having a gate connected to a node between the third reference current source and the third bipolar transistor. The circuit may further include a cascode circuit connected to substantially remove any Early effect error between the first and second bipolar transistors.

BRIEF DESCRIPTION OF THE DRAWING

The invention is illustrated in the accompanying drawing, in which:

FIG. 1 is an electrical schematic diagram of a resistor-ratioed current multiplier/divider, in accordance with the prior art.

FIG. 2 is an electrical schematic diagram of a resistor-ratioed current multiplier/divider, in accordance with one embodiment of the invention.

DETAILED DESCRIPTION OF THE PREFERRED EMBODIMENTS

Figure 3:
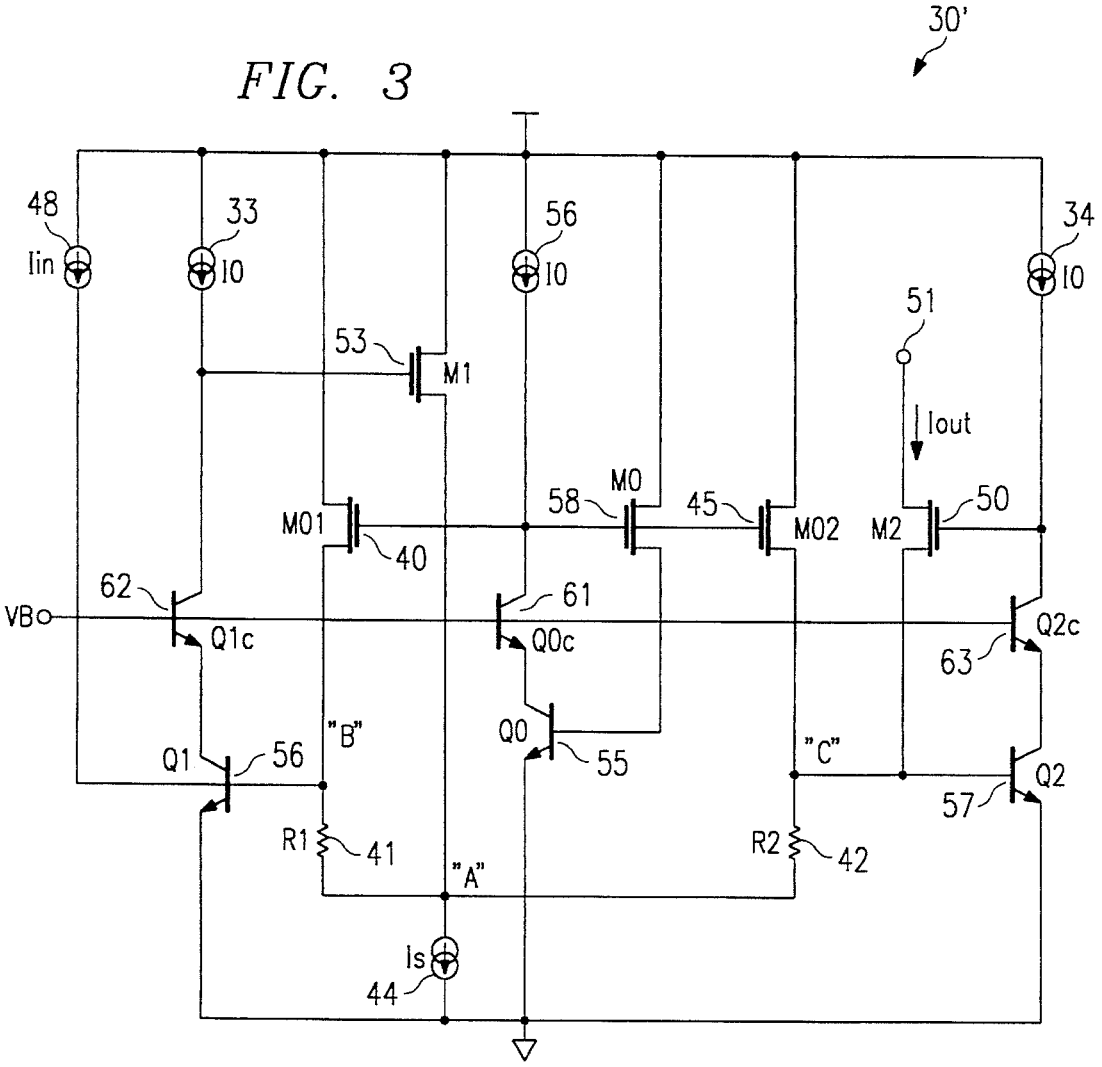
FIG. 3 is an electrical schematic diagram of a cascoded version of a resistor-ratioed current multiplier/divider, in accordance with another embodiment of the invention.

An electrical schematic diagram of a resistor-ratioed current multiplier/divider 30, in accordance with one embodiment of the invention, is shown in FIG. 2. The circuit 30 has two bipolar NPN transistors 31 and 32 connected in series with current sources 33 and 34 between a supply, or $V_{cc}$, rail 37 and a ground rail 38. The current values, I0, of the current sources 33 and 34 are substantially equal.

A first N-channel MOS (NMOS) transistor 40 is connected in series with a first resistor 41 between the supply rail 37 and node "A" at the top side of a current source 44. Also, a second NMOS transistor 45 is connected in series with a second resistor 46 between the supply rail 37 and node "A". The current source 44, which provides a current Is, is connected from the resistors 41 and 46 to the ground rail 38. Although the value of current, Is, provided by the current source 44 is not critical, it should be larger than the sum of the input current, Iin, and the output current Iout.

At the input, an input current source 48, having a current value Iin, is connected to the base of the transistor 31 (node "B") between the NMOS transistor 40 and the resistor 41. At the output, an NMOS transistor 50 is connected between an output terminal 51 and the base of the NPN transistor 32 (node "C") between the NMOS transistor 45 and the resistor 46. The gate of the NMOS transistor 50 is connected to the collector of the NPN transistor 32 to close a loop between the base and collector of the NPN transistor 32.

Another NMOS transistor 53 is connected between the supply rail 37 and node "A" at the top of the current source 44, and the gate of the NMOS transistor 53 is connected to the collector of the NPN transistor 31 to close a loop between the base and collector of the NPN transistor 31. Finally, an NPN transistor 55 is connected in series with a current source 56 between the supply rail 37 and ground rail 38, and an NMOS transistor 58 is connected between the supply rail 37 and the base of the NPN transistor 55. The current source also supplies a current of value, I0, substantially the same as that of current sources 33 and 34. The gates of the NMOS transistors 40, 58 and 45 are connected together and to the collector of the NPN transistor 55.

In operation, the two current sources 33 and 34 bias the NPN transistors 31 and 32 with substantially the same current, I0. Since the collector currents $Ic_{31}$ and $Ic_{32}$ of the NPN transistors 31 and 32 are equal, so are their base emitter voltages, $Vbe_{31}$ and $Vbe_{32}$. The NPN transistor 55 is also biased at I0, and its base current is duplicated from the NMOS transistor 58 by the NMOS transistors 40 and 45 into the bases of the NPN transistors 31 and 32, where all base currents cancel.

With the resistor 41 between the base of the NPN transistor 31 and the source of the NMOS transistor 53, and the input current, Iin, fed into the base node of the NPN transistor 31, the input current will flow through the resistor 41 and will be subtracted from the current, Is, supplied by the current source 44. The difference will go into the NMOS transistor 53, and into resistor 46. This results, for node "A" in $V_A=V_{b31}-R_{41}\cdot Iin$.

With the resistor 46 connected between the node "A" and the base of the NPN transistor 32, connected in a similar arrangement, the following also exists:

$$V_{b32}=V_A+R_{46}\cdot Iout.$$

But, since $V_{be31}=V_{be32}$, $$V_{b32}=V_A+R_{46}\cdot Iout=V_{b31}=V_A+R_{41}\cdot Iin.$$

This implies:

$$Iout=\left(\frac{R_{41}}{R_{46}}\right)\cdot Iin.$$

Without any base current error, the output current is therefore substantially equal to a fraction of Iin, with a ratio given solely by two resistors, resistor 41 and resistor 46.

It should be noted that the output current Iout comes from a high impedance output.

An electrical schematic diagram of a cascoded version of a resistor-ratioed current multiplier/divider 30' in accordance with another embodiment the invention is shown in FIG. 3. The circuit embodiment 30' is similar to the circuit embodiment 30, described above, except for the addition of the NPN transistors 61, 62, and 63 cascoding respectively NPN transistors 55, 56, and 57. The bases of the NPN transistors 61, 62, and 63 are connected to a bias voltage VB. In the circuit embodiment 30' the cascoding of the NPN transistors 55, 56, and 57 by NPN transistors 61, 62, and 63 removes the inaccuracy that may result from the Early effect between NPN transistors 56 and 57 in the circuit embodiment 30 in FIG. 2, since the NPN transistors 56 and 57 have different collector voltages when $Iin\cdot R_{41}$ increases. Mismatches in the different bias currents I0 supplied by the current sources 56, 33, and 34 will only result in offset, but not in gain error.

It will also be appreciated that the circuit has wideband characteristics, since it principally has NPN type transistors. The bandwidth of the various MOS devices can be enhanced by proper sizing of their channel width to length ratios.

Although the invention has been described and illustrated with a certain degree of particularity, it is understood that the present disclosure has been made only by way of example, and that numerous changes in the combination and arrangement of parts can be resorted to by those skilled in the art without departing from the spirit and scope of the invention, as hereinafter claimed.

I claim:

1. A current multiplier/divider, comprising:

first, second and third current paths between a supply voltage and a reference potential, each having a reference current source and a bipolar transistor in series;

a fourth current path, having a summation current source connected at a first side to the reference potential, and having first and second divided current paths each having an MOS transistor with a conduction path and a gate, and a resistor connected in series with the conduction path of the MOS transistor between the supply voltage and another side of said summation current source, a base of the bipolar transistors of the first and third current paths being connected between the conduction path of the MOS transistor and the resistor respectively in the first and second divided current paths;

a fifth current path comprising an MOS transistor having a conduction path connected between the supply voltage and a base of the bipolar transistor of the second current path, and having a gate connected to the gates of the MOS transistors in the first and second divided current paths;

a sixth current path comprising an MOS transistor having a conduction path connected between the supply voltage and said another side of said summation current source, and having a gate connected between the reference current source and the bipolar transistor of said first current path;

and an output current path, having an MOS transistor between a current output terminal and the base of the bipolar transistor of the third current path and between the reference current sourceand the bipolar transistor of the second current path, and having a gate connected between the reference current source and bipolar transistor of the third current path;

wherein an output current is developed at the current output terminal that has a magnitude proportional to an input current applied to the base of the bipolar transistor of the first current path, according to the ratio of the resistors of the first and second divided current paths.

2. The Current multiplier/divider of claim 1 wherein said reference current sources supply substantially equal currents.

3. The current multiplier/divider of claim 1 wherein said bipolar transistors are NPN transistors.

4. The current multiplier/divider of claim 3 wherein said MOS transistors are NMOS transistors.

5. The current multiplier/divider of claim 1 further comprising first and second cascode bipolar transistors connected in series with the bipolar transistors of said first, second and third current paths, each having a base connected to a reference potential, for reducing Early effects in the bipolar transistors of the first and third current paths.

6. A current multiplier/divider circuit comprising:

a first bipolar transistor, having a base for receiving an input current, and having a conduction path;

a first reference current source, for conducting a first reference current, connected in series With the conduction path of the first bipolar transistor between a supply voltage and ground;

a second bipolar transistor, having a base and having a conduction path;

a second reference current source, for conducting a second reference current, connected in series with the conduction path of the second bipolar transistor between the supply voltage and ground;

an output field-effect transistor having a conduction path connected between an output and the base of the second bipolar transistor, and having a gate biased to a node at the series connection of the conduction path of the second bipolar transistor and the second reference current source, for conducting an output current;

a summation current source connected to ground;

a first resistor connected between the base of the first bipolar transistor and said summation current source;

a second resistor connected between the base of the second bipolar transistor and said summation current source; and circuitry for biasing the first and second bipolar transistors to conduct the first and second reference currents, respectively, so that the first and second resistors conduct currents corresponding to the input and output currents, respectively, and so that the ratio of the input current to the output current is determined by the ratio of the first and second resistors.

7. The current multiplier/divider circuit of claim 6 wherein said first and second bipolar transistors are NPN transistors.

8. The current multiplier/divider circuit of claim 6 wherein said first and second reference current sources source substantially equal reference currents.

9. The current multiplier/divider circuit of claim 6, wherein the circuitry for biasing the first and second bipolar transistors comprises:

a circuit having a third bipolar transistor and a third current source connected in series between the supply voltage and ground; and first, second and third MOS transistors connected between the supply voltage and the bases of the first, second and third bipolar transistors, respectively, each MOS transistor having a gate connected to a node between the third reference current source and the third bipolar transistor.

10. The current multiplier/divider circuit of claim 9 wherein said MOS transistors are NMOS devices.

11. The current multiplier/divider circuit of claim 6, further comprising a a plurality of cascode bipolar transistors connected in series with the conduction paths of said first and second bipolar transistors, each of said cascode bipolar transistors having a base connected to a reference voltage.

12. The current multiplier/divider of claim 11 wherein said cascode transistors are NPN bipolar transistors.

* * * * *